United States Patent [19]

Yonker et al.

[11] 4,428,557

[45] Jan. 31, 1984

[54] SINGLE LINE DEEP DEPTH SAFETY VALVE

[75] Inventors: John H. Yonker; Ernest P. Fisher, Jr., both of Carrollton, Tex.

[73] Assignee: Otis Engineering Corporation, Dallas, Tex.

[21] Appl. No.: 343,849

[22] Filed: Jan. 29, 1982

Related U.S. Application Data

[63] Continuation of Ser. No. 75,239, Sep. 13, 1979, abandoned.

[51] Int. Cl.[3] ..... F16K 31/122; E21B 33/00

[52] U.S. Cl. ..... 251/62; 251/58; 166/322; 166/323; 166/324

[58] Field of Search ..... 251/58, 62, 63.6; 166/321, 324, 322, 323, 325

[56] References Cited

U.S. PATENT DOCUMENTS

| | | | |
|---|---|---|---|
| 3,007,669 | 11/1961 | Fredd | 251/58 |
| 3,078,923 | 2/1963 | Tausch | 166/324 |
| 3,289,691 | 12/1966 | Kennard | 166/325 |
| 3,799,204 | 3/1974 | Watkins et al. | 166/324 |
| 4,119,147 | 10/1978 | Arendt et al. | 166/155 |
| 4,149,698 | 4/1979 | Deaton | 251/63.6 |

*Primary Examiner*—A. Michael Chambers
*Attorney, Agent, or Firm*—Vinson & Elkins

[57] ABSTRACT

A single control line, surface controlled subsurface safety valve for controlling flow in a well, having a valve closure member responsive to the longitudinal movement of an operator tube disposed in the bore of the safety valve. The operator tube is moved to a position opening the valve closure member by action of a piston, housed in an annular pressure zone, which is responsive to control fluid pressure from the surface of the well. The operator tube is returned to a position closing the valve closure member by action of a resilient urging means housed in an annular chamber located above the annular pressure zone. There is no pressure differential between the bore of the safety valve and the annular chamber housing the resilient urging means.

4 Claims, 8 Drawing Figures

SINGLE LINE DEEP DEPTH SAFETY VALVE

BACKGROUND OF THE INVENTION

1. Field of the Invention

This invention relates to an improved well safety valve for use in controlling well fluids conducted through the well tubing bore. More particularly, the safety valve is adapted to be set at depths much deeper than previously possible, using a single control line for operation of the valve.

2. The Prior Art

Surface controlled subsurface safety valves have been used to control flow in a well at subsurface locations for some time. It is well known to provide a well safety valve to control the fluid flow in a well conduit by means of a valve closure member, disposed in the bore of the safety valve, which is movable between an open and a closed position. The closure member is moved to the bore open position by means of a piston and pressure chamber arrangement whereby control fluid is usually pressurized at the surface of the well and the fluid, conducted to the safety valve pressure chamber via suitable conduit, causes the piston to operate an operator member acting on the closure member. Release of pressure allows a spring or other resilient urging means to return the closure member to the bore closed position.

In order for the spring to push the operator member to its normal "at rest" position, closing the closure member, the spring must overcome the hydrostatic pressure exerted on the piston by the column of control fluid extending from the safety valve to the surface of the well. At deep well locations, this is an acute problem and thus, it is often decided to use a two-line, "balanced" safety valve, wherein the hydrostatic pressure in the control line is offset by the hydrostatic pressure of a second fluid filled conduit, extending from the safety valve to the surface of the well. Such balanced safety valves are well known. Reference is made to copending application Ser. No. 960,168 now U.S. Pat. No. 4193450, issued 3/18/80, filed by one of the present inventors, directed to a two-line balanced subsurface safety valve.

If, however, it were possible to strengthen the spring which closes the valve while reducing the annular area of the piston, single line subsurface safety valves could be set at much deeper locations. The limiting factor for selecting spring size and strength has always been the volume provided for housing the spring, in the safety valve. With the control piston located above the spring the safety valve housing must withstand the large pressure differentials due to placement of external seals; consequently, little internal spring housing volume remains.

Typically, with the piston and pressure chamber being located at an opposite end of the safety valve from the valve closure member, the closure spring has been placed therebetween. Such an arrangement provides only limited space for increasing spring size.

Consequently, an object of the present invention is to provide a surface controlled, subsurface safety valve, having a single control line, that can be set at depths in a well which are greater than previously practical for single control line safety valves.

Another object of the invention is to provide a surface controlled subsurface safety valve having a relatively large closure spring in relation to the piston surface area.

Yet another object is the provision of a very high piston pressure, in relation to the overall size of the safety valve of the present invention.

A further object of the present invention is to provide a surface controlled, subsurface safety valve having control fluid expandable pressure chamber-piston zone interspersed between the valve closure member and the closure spring housing.

Yet another object is to provide a means for equalizing the pressure between the bore of the safety valve of the invention, the interior closure spring housing, and the exterior of the closure spring housing above the packing in a retrievable valve.

SUMMARY OF THE INVENTION

A surface controlled subsurface safety valve comprising a housing having a longitudinal bore therethrough defining a flow path, closure means for controlling flow through said bore, operator means longitudinally movable with respect to said housing for moving said closure means and having a first position wherein said closure means closes said flow path and having a second position wherein said closure means opens said flow path, a pressure zone adapted for receiving control fluid under pressure, a piston housed in said pressure zone responsive to said controlfluid wherein an increase in pressure in said pressure zone causes said piston to be moved to a position therein moving said operator means to its second position, resilient urging means for urging said operator means to move said closure means to its first position, said pressure zone being spaced between said resilient urging means and said closure means.

BRIEF DESCRIPTION OF THE DRAWINGS

The above and other objects, advantages and features of the present invention will become more apparent upon consideration of the following specification, taken in connection with the accompanying drawings, wherein.

DESCRIPTION OF THE PREFERRED EMBODIMENTS

Figure 3A:
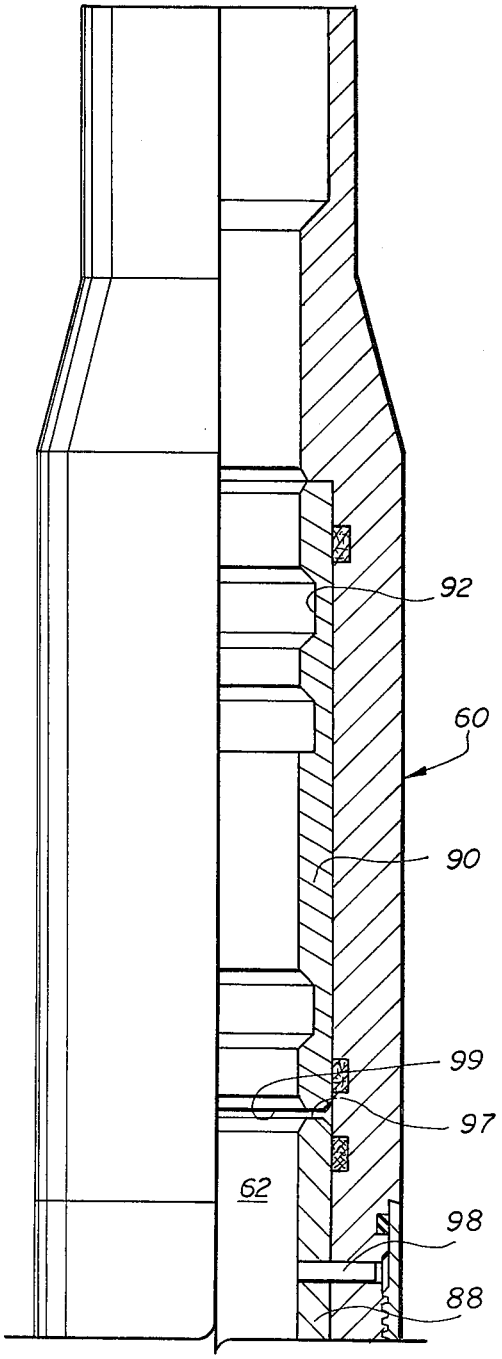
FIGS. 3A–C are elevational drawings, partly in crossection, illustrating the present invention adapted to a tubing retrievable, surface controlled subsurface safety valve, with the valve closure member in the bore closed position.
Figure 3B:
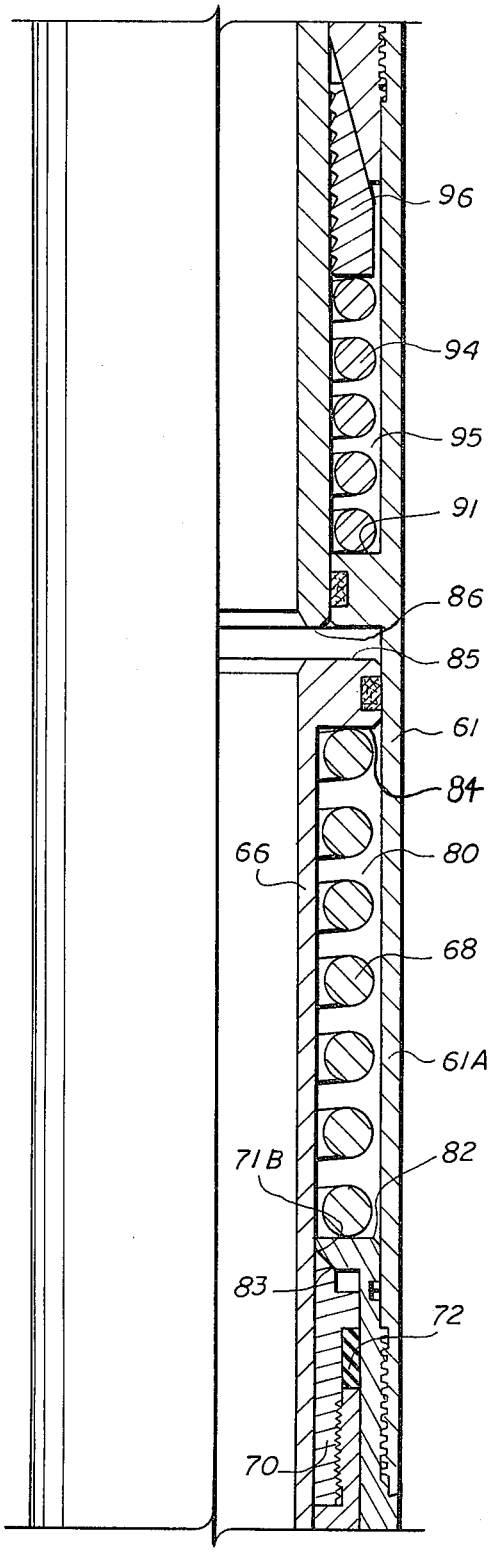
Figure 3C:
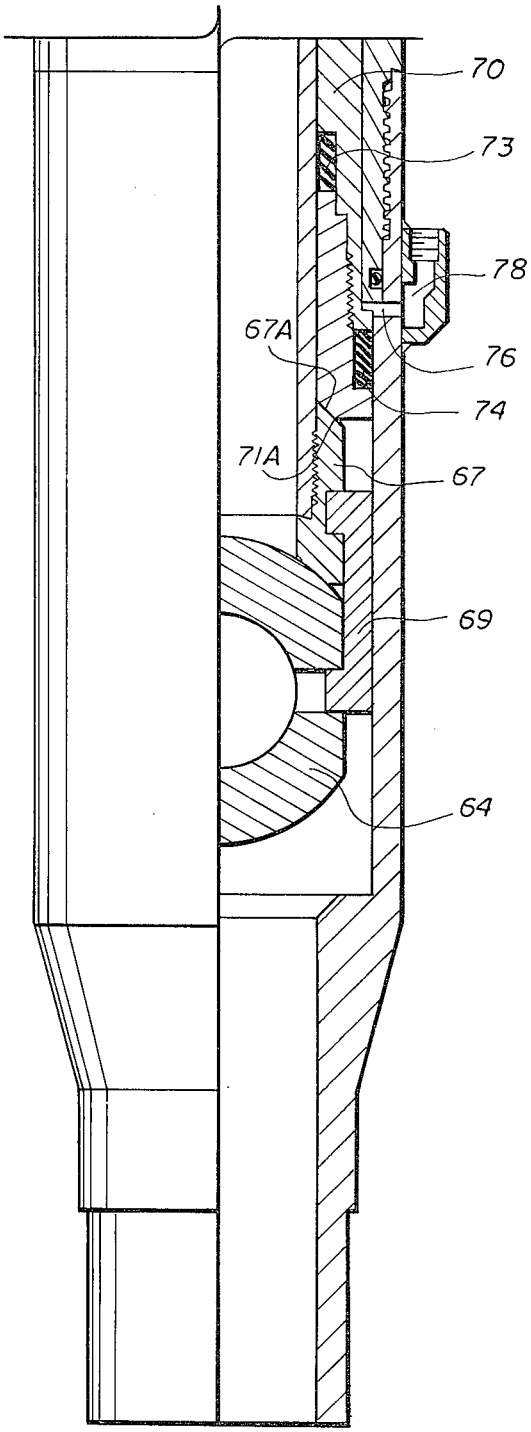

The present invention is applicable to surface controlled subsurface safety valves in general, whether they are connectable in the tubing string, such as shown in FIGS. 3A–C, or they are through the flow line (TFL) or "wire line". By "wire line" is meant that the safety valve is lowered into and retrieved from a well tubing by wire line, as opposed to tools which are set in well tubing by the "pump down" or TFL method.

Figure 1:
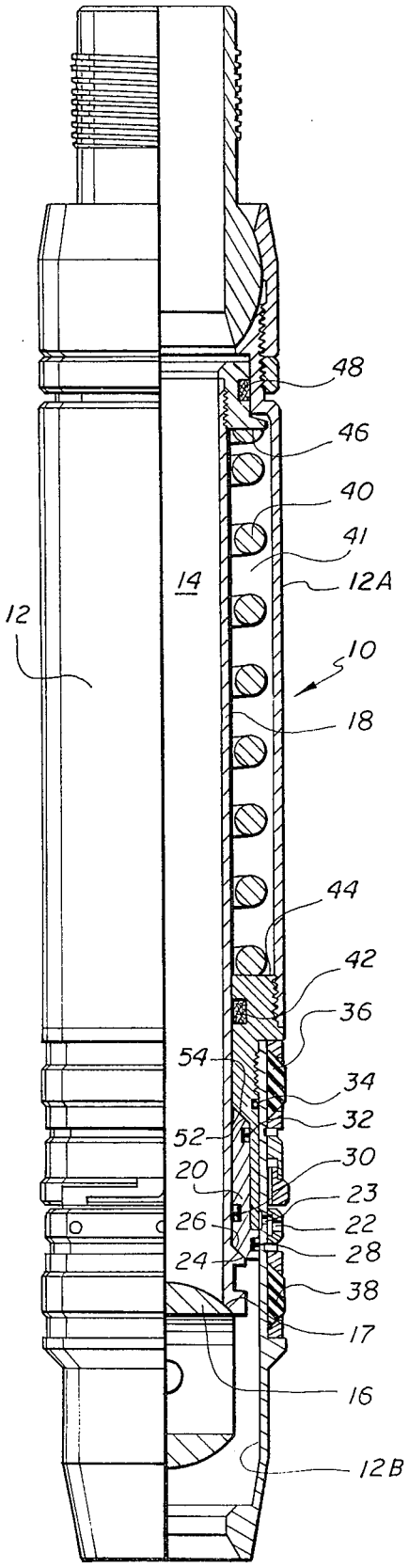
FIG. 1 is an elevational drawing, partly in crosssection, illustrating one embodiment of the present invention consisting of a through the flow line surface controlled subsurface safety valve, with the valve member in the bore closed position.
Figure 4:
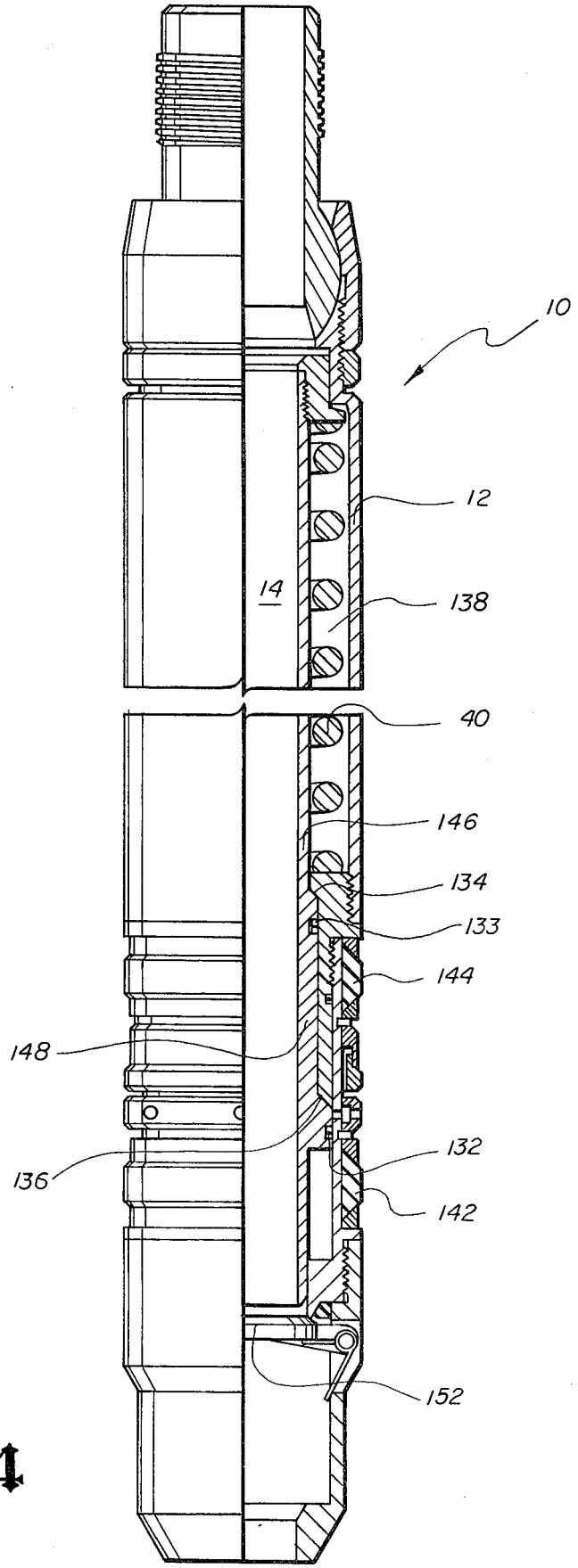
FIG. 4 is a partial sectional view of the safety valve of the invention having a flapper closure member.

FIG. 1 illustrates a TFL-type safety valve 10 in order to describe the features of the present invention. It can be seen therein that the safety valve 10 comprises a housing 12 having a bore 14 extending longitudinally therethrough. Disposed in the bore 14 is a valve closure member 16, seated against a metal seat 17 which is on the end of an operator tube 18 which is movable longitudinally with respect to the housing 12 to move the closure member 16 to a first position wherein the closure member closes the bore 14, and a second position wherein the closure member 16 opens the bore 14. While the drawings illustrate a ball type closure member, the invention is equally applicable to a "Flapper" type closure member safety valve, as shown in FIG. 4, discussed hereinafter.

The operator tube 18 is moved to its second position, causing the closure member 16 to move to the bore open position, by the action of piston 20. The piston 20 is a concentric ring disposed essentially between the operator tube 18 and the bore wall **12*b* of the housing 12, and carrying O-ring seals 28 and 32 on its outside diameter and seal means 30 on its inside diameter. The annular area between O-ring seals 28 and 32** is the area acted upon by control pressure fluid.

The piston 20 is housed in a pressure zone 23 which is defined by a cavity which lies essentially between the operator tube 18 and a portion of the housing bore wall **12*b*. There is provided a flow path 22 for admitting control pressure fluid from the exterior of the safety valve housing 12 to the interior of the pressure zone 23. When the piston 20 is in its "rest" position, shown in FIG. 1, upper piston face 54 contacts face 52** of the piston housing.

While FIG. 1 illustrates the safety valve 10 having a piston 20 "floating" free in the pressure zone 23, the piston 20 may be connected to and be a part of the operator tube 18. If this is done, there is no longer a need for the seal member 30 or the piston 20. However, by using a "floating" piston 20, as illustrated, it is possible to kill the well by pumping, under pressure, a fluid down the tubing to force open the valve closure member 16. When the valve closure member 16 is in the valve closed position, as shown in FIG. 1, the piston 20 is at its uppermost position. Assuming that it would be desirable to "kill" the well with fluids pumped under pressure from the surface of the well, these fluids would exert a force on the valve closure member 16, forcing same downward, along with the operator tube 18. At some point the metal seat 17 would be forced open to permit passage of the pumped fluids. The free floating piston 20 is moved upward by the pressure of the pumped fluids passing the metal-to-metal seat 17, so that upper piston face 54 essentially contacts face 52 of the piston housing. If the piston 20 were attached to the operator tube 18, the operator tube would be urged upward, causing the valve closure member 16 to "chatter" leading to potentially serious damage and inability to flow sufficient fluids down the well. This is an important safety feature in surface controlled, subsurface safety valves.

Control pressure fluid is normally supplied to a TFL or wire line safety valve, such as described herein, by conducting such fluid through conduit (not shown) that traverses the exterior of the tubing string. The conduit usually runs from a pressure manifold, at the surface of the well down to a landing nipple, as in FIG. 2, or to a tubing retrievable safety valve, as in FIG. 3, housing the present invention.

Figure 2A:
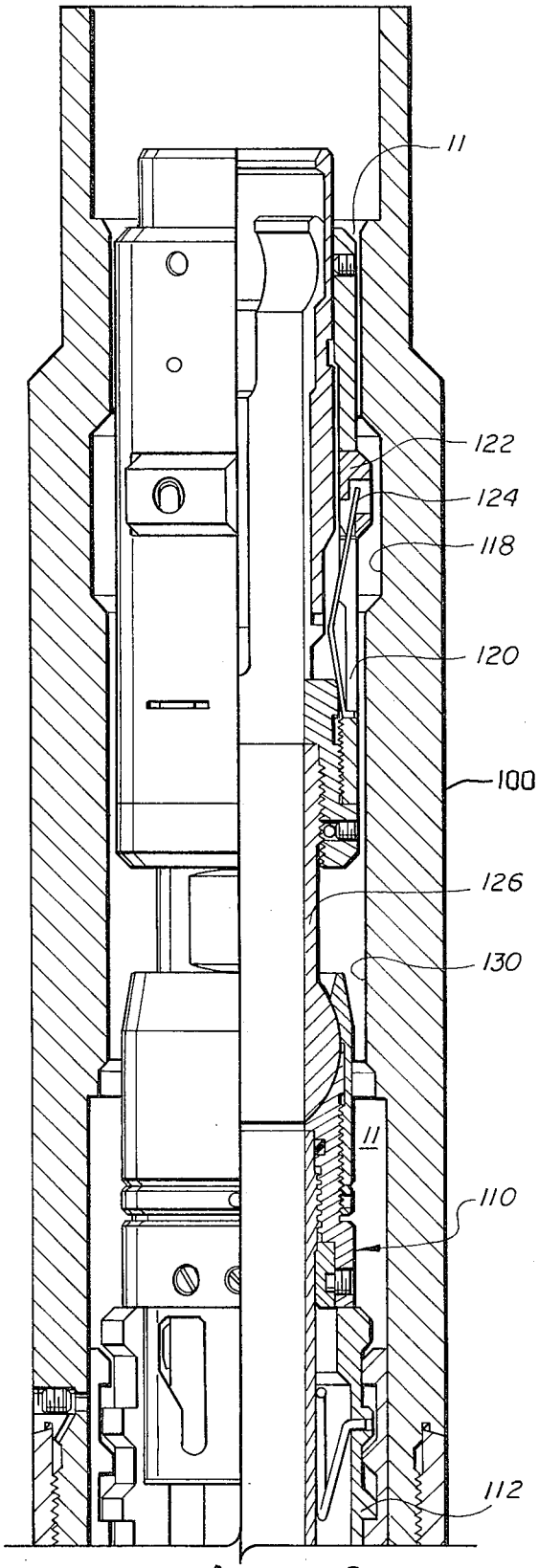
FIGS. 2A–C are elevational drawings, partly in crossection, illustrating the safety valve of FIG. 1 landed in a suitable landing nipple in a well and wherein the valve closure member is in the bore open position and the safety valve has attached thereto a shifting tool and a lock mandrel.
Figure 2B:
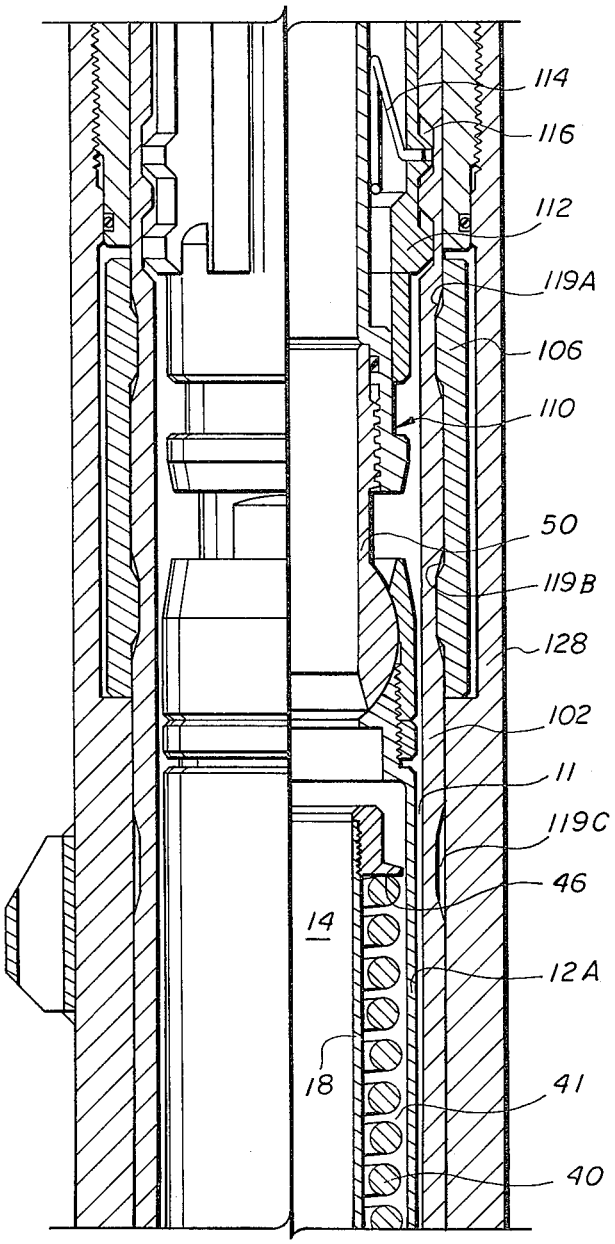
Figure 2C:
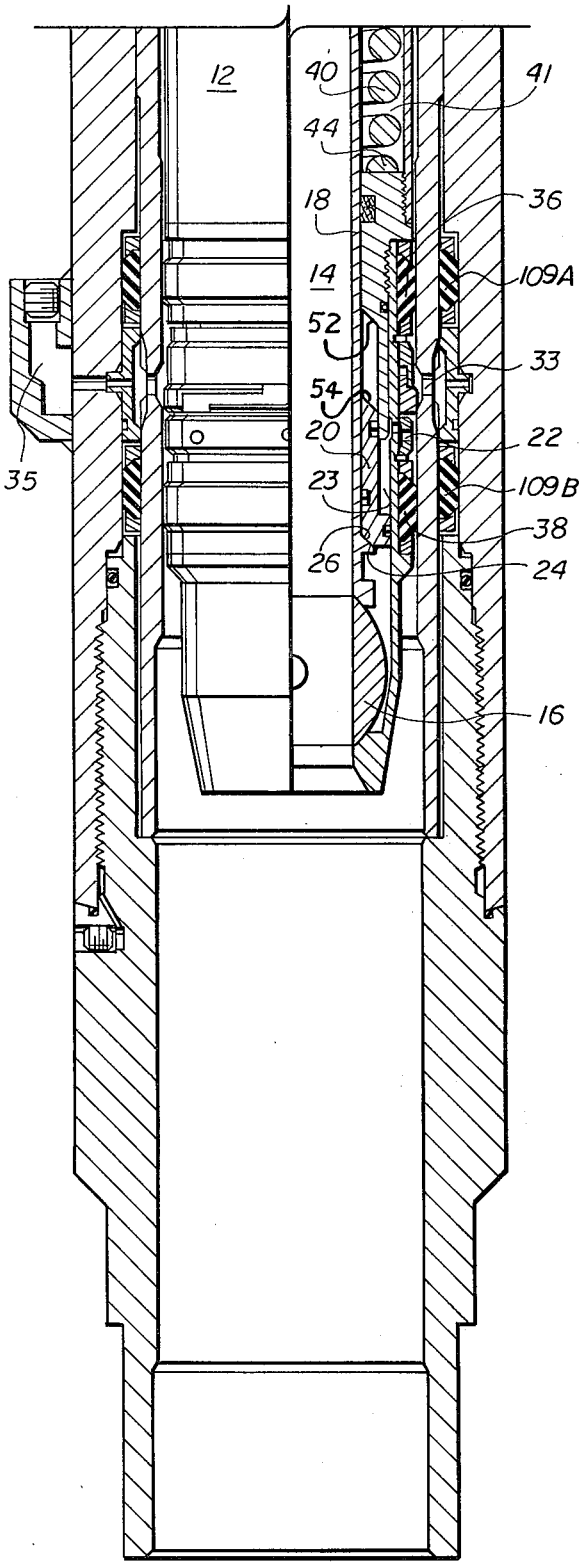

When the control pressure fluid is subjected to a predetermined pressure, sufficient to operate the safety valve, piston 20 is moved toward the valve closure member, engaging a chamfered protruding face 26 on the operator tube 18 with a matching face 24 on the piston 20. Continued movement of the piston 20, in this direction, causes the operator tube 18 to move and rotate the valve closure member 16 to its bore open position, as best illustrated in FIG. 2C.

As long as there is sufficient pressure maintained in the pressure zone 23, the valve closure member 16 will remain in the bore open position. Upon release of the pressure within pressure zone 23, the operator tube 18 is returned to its first position, as illustrated in FIG. 1, by the "pulling" force applied thereto by a resilient urging means, shown in the drawing to be a spring 40. The spring 40 is housed in the annular space 41 between the operator tube 8 and bore wall of housing member **12*a*. This annular space 41 is spaced above the pressure zone 23, as illustrated in the drawings, and will be referred to hereinafter as the "spring housing 41**".

The pressure zone 23, an area of the safety valve housing the piston 20, is subjected to a differential in pressure. This area is bounded, on the outside of the safety valve housing, by at least two seal members 36 and 38. When these seals 36 and 38 are engaged with a honed bore wall of a landing nipple, in the well tubing string, as shown in FIGS. 2A–C, there is established a pressure differential between: (a) the area between seals 36 and 38, and (b) the area lying outside this sealed area.

There is no differential in pressure between the spring housing 41, the bore 14 of the safety valve 10, and the space 11 between the outside of the safety valve 10 and the bore wall 130 of the landing nipple 128.

Consequently, the thickness of material used in the housing member **12*a* and the operator tube 18 can be substantially reduced. This provides a larger volume in the spring housing 41 so that larger diameter spring wire can be used to construct the spring 40 to be housed in the spring housing 41**.

The spring 40 is confined between a shoulder 46, connected to the uppermost end of the operator tube 18, and a shoulder 44 at the lower end of housing **12*a*. As described above, release of control pressure in pressure zone 23 allows the spring 40 to act upon the operator tube shoulder 46 to "pull" the operator tube 18 to a position moving the closure member 16 to its bore closed position, seating against the metal seat 17 on the end of the operator tube 18**.

Of course, release of control pressure in the pressure zone 23 does not relieve the effects of the pressure exerted on the piston 20 by the column of control pressure fluid extending from the safety valve 10 to the surface of the well. This hydrostatic head exerts a pressure on the pressure zone 23 resisting closing of bore 14 by valve closure means 16. Spring 40 must be sized to overcome this force. Because of limitations in space within the spring housing 41, it is possible to provide a spring with a finite size wire. Thus, when the efforts of the spring and piston annular area are combined, the safety valve is limited in the depth to which it can be set. Piston pressure is defined as the ratio of spring force at closure to piston area. As a consequence of the much greater capacity of the spring housing 41, in this invention, evolving placement therein of a spring exerting a larger than normal spring force, and use of a small piston area, the valves of the invention have the capability of being placed at deeper locations in a well. This is done while at the same time retaining standard bore sizes for the flow of production fluids through the safety valve.

An added advantage is the ability to now eliminate seals being used in the swivel joints of the TFL tool train. This is due to the fact that all packing elements, such as 36 and 38, are contained on the valve 10 itself, and the control pressure fluid is confined therebetween.

By eliminating the differential pressure applied on the operator tube 18 and/or the housing member 12*a*, springs of greater relative size can be used in the increased volume of the spring housing 41. Another advantage of the present invention resides in the fact that the piston 20 permits the "pump through" of fluids in order to "kill" the well in case of an emergency. As previously noted, piston 20 is preferably free "floating" or decoupled from the operator tube 18. Thus, when pumping through the valve 10, closure member 16 and operator tube 18 move downwardly compressing the spring 40 against the shoulder 44. Since piston 20 is not directly coupled to the operator tube 18, piston 20 can remain at rest position, as shown in FIG. 1, while pumping through the valve 10. A felt wiper 48 is provided on the upper end of the operator tube 18 to provide a wiping effect on the inner surface of the housing member 12*a*, which is in contact with the operator tube 18. The felt wiper 48 is not absolutely necessary and in fact is not used in the embodiment shown in FIG. 2B. As pointed out above, there is no differential in pressure between the spring housing 41 and the bore 14 of the safety valve 10. A similar felt wiper 42 is positioned between the operator tube 18 and a portion of the valve housing above the piston 20, so that there is no restriction between the spring housing 41 and the upper surface 54 of the piston 20.

It was discovered that by keeping the piston area very small in relation to the large wire diameter spring, the piston pressure is enhanced sufficiently to permit setting of the present safety valve 10 at extremely deep depths.

The safety valve illustrated in FIG. 3 demonstrates that the present invention is equally applicable to tubing retrievable subsurface safety valves. The safety valve 60 shown therein is connectable in a well tubing string (not shown) and comprises a housing 61 having a bore 62 extending longitudinally therethrough defining a flow path. A closure member 64 is housed in the bore 62 and is movable between positions opening and closing the bore 62 flow path.

The closure member 64, shown to be a ball valve, is moved to its positions opening and closing the bore 62 flow path by operation of an operator tube 66 which is longitudinally movable within the bore 62 of the safety valve 60, in a manner similar to that described, above, for the TFL and wire line safety valves.

The piston 70, in the tubing retrievable safety valve 60, engages the operator tube 66, for moving same to open the closure member 64, by contacting a chamfered shoulder 71*a* extending from the operator tube 66 with a matching chamfered surface 67*a* on the end of the piston 70.

The piston 70 is caused to move to a position opening the closure member 64 by expansion of the pressure zone 76 which is in communication with the surface of the well through conduit (not shown) entering pressure fluid entry port 78, under pressure. As the pressure zone 76 expands, the piston 70 moves toward the closure member 64 with the surface 71*a* of the piston 70 engaging the shoulder 67*a* causing the closure member 64 to be moved and rotated to the bore open position. The pressure zone of the piston is defined as a surface area of the piston 70 lying between seals 72 and 74 which are on and carried by the piston 70. As long as control pressure within zone 76 is maintained above a preselected value by the continued application of pressure at the surface of the well, the closure member 64 remains in the bore open position.

On release of surface pressure, the closure member 64 is returned to its bore closed position by action of a resilient urging means, in this case shown to be a spring 68 housed within a space 80 between the outside of the operator tube 66 and the bore wall of the housing 61*a*. The space or cavity 80 is not sealed from the safety valve bore 62. Thus, there is no differential pressure between the space 80 and the bore 62. Hereinafter, the space 80 will be referred to as the "spring housing" since the spring 68 is housed therein.

Movement of the piston 70 to cause the closure member 64 to move to its bore open position causes the spring 68 to be compressed within the spring housing 80. As stated above, relaxation of pressure within the pressure zone 76 permits the spring 68 to return to its normal position in the spring housing 80, as shown in FIG. 3. In the normal position, the spring 68 maintains the closure member 64 in the bore closed position. The spring 68 is retained by a shoulder 84 extending outwardly from the operator tube 66, with the shoulder 84 engaging the inner wall of the housing member 61*a*. The opposite end of the spring 68 engages a shoulder 82*a* at the opposite end of housing member 61*a*. Shoulder 82 is engaged with the bore wall of the housing member 61*a* and remains stationary. The piston 70 is limited in its travel to its at rest position by the action of a chamfered face 83 of the piston 70 engaging a chamfered face 71*b* of the shoulder member 82.

Due to the fact that the pressure zone of the safety valve 60 is confined to the area between the seals 72 and 74 of the piston 70, it is possible to reduce the strength requirements and thickness of the operator tube 66. This permits the use of a spring 68 having a larger wire diameter than would be normally possible. This is a result of placing the spring 68 in a position opposite the pressure zone 76 from the valve closure member 64. The tubing retrievable subsurface safety valve illustrated in FIG. 3 is shown to have additional features such as provision for locking out the closure member 64 for use of an auxiliary subsurface safety valve (not shown) in the event that it is desired to remove the tubing retrievable safety valve 60 from service.

This would be accomplished by running a shifting tool through the bore of the tubing string and engaging a profile 92 in a siding sleeve 90, forcing the shifting tool to be moved in a position to shift the sleeve 90 toward a secondary, intermediate sleeve 88. The shifting sleeve 90, would be engaged with the intermediate sleeve 88 by contacting the upper face 97 of the intermediate sleeve 88 with the lower face 99 of the shifting sleeve, shearing a retaining shear pin 98 and forcing this intermediate sleeve 88 to engage the end 85 of the operator tube 66. The end 85 of the operator tube 66 is engaged thus by the lower end 86 of the intermediate sleeve 88, causing the operator tube to be forced toward the closure member 64 rotating same to the bore open position. A lock out member 96 would then engage the intermediate sleeve 88 causing the intermediate sleeve to be retained in its shifted position maintaining the closure member 64 in the bore open position.

Once the safety valve 60 had been locked in the bore open position, a secondary, auxiliary subsurface safety valve could be landed in a landing nipple located preferably above the safety valve 60 for controlling the flow of fluids through the tubing string. A suitable landing nipple, for the purpose of receiving a safety valve as described hereinabove, is illustrated in FIG. 2, along with the safety valve of this invention landed therein. Thus, in this manner, the present invention can be embodied in a tubing retrievable subsurface safety valve such as illustrated in FIG. 3 with a provision of a landing nipple preferably arranged above the tubing retrievable subsurface safety valve, and the setting of a wire line or TFL safety valve, embodying the present invention, in the landing nipple. However, other landing nipples or safety valves could be used in tandem with the tubing retrievable safety valve shown in FIG. 3. Alternatively, other tubing retrievable subsurface safety valves could be connected in this tubing string with the provision in the tubing string of the landing nipple and auxiliary safety valve set therein as shown in FIG. 2.

In utilizing a landing nipple connected in the tubing string such as the landing nipple 100 shown in FIG. 2, a sliding sleeve 102 disposed in the bore of the landing nipple 100 would be in a normal unshifted position (not shown). As illustrated in FIG. 2, the sleeve 102 is shifted downward to a position permitting access of control fluid from a source at the surface of a well (not shown) terminating at the landing nipple 100 at a control pressure fluid entry port 35. Once the control pressure fluid enters the landing nipple 100 through the entry port 35, the fluid would normally be sealed from entering into the bore of the landing nipple by seals **109*a* and 109*b* which surround the bore entry extension of the control fluid port 35. With the sleeve shifted upward, the bore access port 33 is sealed from communication with the entry port 35 by having seal 109*a*** interposed therebetween.

Thus, as shown in FIG. 2, the sleeve 102 has been shifted downward providing access, via port 33, to the bore 130 of the landing nipple 100. The sleeve 102 is shifted to the illustrated downward position by action of keys 112 engaged in a bore profile 116 of the sleeve 102, the keys 112 being carried by shifting mandrel 110 connected to the subsurface safety valve 10 by knuckle joint connector 50. The configuration shown in FIG. 2 illustrates a TFL tool string including the safety valve 10, the shifting tool 110 and a lock mandrel 120. The lock mandrel 120 carries keys 122 which are biased by a spring 124, into a bore recess 118 in the bore wall of the landing nipple 100.

The keys 112 of the shifting mandrel 110 are maintained in a biased outwardly position by means of a spring or other biasing means 114 carried on the body of the shifting mandrel 110. Shifting mandrels and lock mandrels, acting in a manner illustrated in FIG. 2 are well known in the art.

The sleeve is retained in its shifted position, whether it has been shifted to the operating position shown in FIG. 2 or shifted upwardly to its inoperative position, by means of a tension member 106 which engages recesses **119*a*, 119*b*, or 119*c*. Recess 119*b*, being the center recess is always engaged by the tension member 106 with either 119*a* or 119*c*** recess being engaged depending on whether the sleeve has been shifted up or down.

With the sleeve 102 shifted downward as illustrated in FIG. 2, the subsurface safety valve 10 is operable in the manner described hereinabove.

Referring to FIG. 4, there is seen an illustration of the safety valve 10 of the invention having a flapper 152 closure member disposed in the bore 14 of the safety valve 10. The safety valve 10 is adapted for use in a through the flow line tool string (not shown).

Operation and assembly of the safety valve 10, shown in FIG. 4 is essentially the same as the safety valve 10 of FIG. 1. It can be seen therein that the safety valve 10 comprises a housing 12 having a bore 14 extending longitudinally therethrough. Disposed in the bore 14 is a flappertype valve closure member 152, suited against a metal seat which is formed on the end of an operator tube 146 which is movable longitudinally with respect to the housing 12 to move the closure member 152 to a first position wherein the closure member 152 closes the bore 14, and a second position where the closure member 152 opens the bore 14.

The operator tube 146 is moved to its second position, causing the closure member 152 to move to the bore open position, by the action of hydraulic control pressure fluid acting upon a piston surface 136 which is formed on the operator tube 146. Pressure fluid entering through the housing 12 to act upon the piston surface 136 is confined in the housing by the action of O-rings 132 and 133, which are carried on the outside of the operator tube 146 and are positioned on either side of the piston surface 136. Thus, the annular area between O-ring seals 132 and 133 is the area acted upon by controlled pressure fluid.

A second pressure responsive surface 134 is positioned on the outer surface of the operator tube 146, above the O-ring seal 133. In the event it is desired to kill the well by pumping, under pressure, a fluid down the tubing to force open the valve closure member 152, the kill fluid would enter the annular space 138 between the housing 12 and the operator tube 146 and act upon the pressure responsive surface 134 to assist in moving the operator tube 146 downwards sufficiently to open the closure member 152. This permits the kill fluid to pass through the closure member 152 and travel through the production tubing string (not shown) to kill the well.

As with the safety valve 10 discussed with reference to FIG. 1, sealing members 142 and 144 are positioned on the housing 12 to provide a pressure zone for confining control pressure fluid directed to the safety valve 10 when it is placed in a suitable landing nipple.

What is claimed is:

1. A subsurface safety valve comprising, an elongate rigid tubular housing, at least two spaced annular seals on the exterior of and adjacent one end of said housing, a port in the housing between said seals for receiving control pressure fluid, a valve seat and cooperable valve member controlling flow through said housing, a tubular actuator in the housing controlling movement of said valve member between said open and closed positions, an annular piston disposed on said actuator, said piston having outer diameter sections of different diameter, spaced sliding seal means between said housing and a respective one of said different diameter sections of said piston to provide a pressure responsive member, said sliding seal means in open and closed positions of said valve member positioned approximately within the area defined by said spaced annular seals, and spring means positioned within the housing and spaced longitudinally from the area between said pair of annular seals, the interior and exterior portions of the housing containing said spring means exposed to the same pressure fluid, fluid pressure through said port acting on said piston to actuate said valve.

2. A subsurface safety valve comprising, an elongate rigid tubular housing, at least two spaced annular seals on the exterior of and adjacent one end of said housing, a port in the housing between said seals for receiving control pressure fluid, a valve seat and cooperable ball valve member controlling flow through said housing, a tubular actuator in the housing controlling movement of said valve member between open and closed positions, said actuator having an external upwardly facing shoulder, an annular piston slidable about the actuator and within the housing and engageable with said shoulder, said piston having outer diameter sections of different diameter, spaced sliding seal means between said housing and a respective one of said different diameter sections of said piston to provide a pressure responsive member, said sliding seal means in open and closed positions of said valve member positioned approximately within the area defined by said spaced annular seals, and spring means positioned within the housing and spaced longitudinally from the area between said pair of annular seals, the interior and exterior portions of the housing containing said spring means exposed to the same pressure fluid, fluid pressure through said port acting on said piston to actuate said valve.

3. A subsurface safety valve comprising, an elongate rigid tubular housing, a port in the housing for receiving control pressure fluid, a valve seat and cooperable valve member controlling flow through said housing, a tubular actuator in the housing controlling movement of said valve member between open and closed positions, said actuator having an external upwardly facing shoulder, an annular piston slidable about the actuator and within the housing and engageable with said shoulder, said piston having outer diameter sections of different diameter slidably movable in comparable different diameter sections of said housing, spaced sliding seal means between said different diameter sections of said housing and said different diameter sections of said piston to provide a pressure responsive member, and spring means in said housing urging said actuator toward valve closing position said pressure responsive member responsive to said control pressure fluid urging said piston into engagement with said shoulder to shift said actuator toward said valve open position.

4. The valve of claims 2 or 3 wherein sliding seal means is provided between said actuator and said piston.

* * * * *